United States Patent [19]

Alford

[11] 4,330,398

[45] May 18, 1982

[54] FLOTATION OF PHOSPHATE ORES WITH ANIONIC AGENTS

[75] Inventor: John A. Alford, Hanahan, S.C.

[73] Assignee: Westvaco Corporation, New York, N.Y.

[21] Appl. No.: 84,149

[22] Filed: Oct. 12, 1979

[51] Int. Cl.[3] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,012,609 | 8/1935 | Lenher | 209/166 |
| 2,120,217 | 6/1930 | Harris | 209/166 |
| 3,122,500 | 2/1964 | Gullett | 209/166 |
| 3,353,672 | 10/1967 | Sollin | 209/166 |
| 3,361,257 | 1/1968 | Kaseman | 209/166 |
| 3,405,802 | 10/1968 | Preller | 209/166 |
| 3,780,860 | 12/1973 | Fischer | 209/167 |
| 3,827,557 | 8/1974 | Fischer | 209/167 |
| 4,040,519 | 8/1977 | Fukazawa | 209/166 |
| 4,138,350 | 2/1979 | Wang | 252/61 |
| 4,139,481 | 2/1979 | Wang | 252/61 |
| 4,139,482 | 2/1979 | Wang | 252/61 |
| 4,171,261 | 10/1979 | Dorrepual | 252/61 X |

FOREIGN PATENT DOCUMENTS

| | | | |
|---|---|---|---|
| 598232 | 5/1960 | Canada | 209/166 |
| 836589 | 4/1938 | France | 209/166 |
| 78-3835 | 6/1979 | South Africa . | |
| 441454 | 4/1934 | United Kingdom | 209/166 |
| 294644 | 6/1967 | U.S.S.R. | 209/166 |

OTHER PUBLICATIONS

Report, Bhabha Atomic Res. Ctr., India, 1976, Barc-857, pp. 1-31.

Chem. Abst., 87, 1977, 104193c.

Chem. Abst., 78, 1973, 86691w.

*Primary Examiner*—Robert Halper

*Attorney, Agent, or Firm*—Richard L. Schmalz; Terry B. McDaniel

[57] ABSTRACT

An anionic flotation agent comprising naturally derived fatty acids and, as a promoter, a sulfonated ethoxylated alcohol provides improved beneficiation and improved grade of phosphate ores by froth flotation.

8 Claims, No Drawings

FLOTATION OF PHOSPHATE ORES WITH ANIONIC AGENTS

BACKGROUND OF THE INVENTION (1) Field of the Invention

This invention relates to the beneficiation of phosphate ore by froth flotation using an anionic flotation agent comprised of naturally derived fatty acids and, as a promoter, a salt of an ether sulfate. More specifically, the fatty acids are derived from a vegetable or animal oil and the ether sulfate is of the general formula $$R(OCH_2CH_2)_nOSO_3^-M^+$$

wherein $M^+$ is selected from the group consisting of $Na^+$, $K^+$ and $NH_4^+$, n is from 1 to 6 and R is an alkylaryl group or $CH_3(CH_2)_x$—wherein x is from 6 to 20.

(2) Description of the Prior Art

Agents, often called collectors, are used in conjunction with froth flotation to aid in the beneficiation of phosphate, $P_2O_5$, from phosphate rock. Phosphate rock is a natural rock consisting largely of calcium phosphate and used chiefly as a raw material for manufacture of phosphate fertilizers, phosphoric acid and phosphorus, and therefore indirectly used for practically all commercial phosphorus chemicals. Important deposits of phosphate ore are in Florida, North Carolina, Tennessee, Wyoming, Montana, Utah, Idaho and North Africa. The deposits, however, also contain siliceous materials, such as silica which are valueless constituents. Other valueless constituents such as calcium carbonate, some carbonaceous materials and heavy minerals may also be present.

Many methods have been used to beneficiate or concentrate the phosphatic constituents by flotation from the siliceous, carbonaceous and heavy mineral constituents. Froth flotation is the principal means by which phosphate and other ores are concentrated.

Flotation, generally, is a process for separating finely ground valuable minerals from their associated gangue, or waste, or for separating valuable components one from another. In froth flotation frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Froth flotation agents used in conjunction with flotation must be capable of selectively coating the desired material in spite of the presence of many other mineral species.

Commonly, partial concentration is first employed to remove slimes and the phosphate values are then extracted from the sized slurry using two froth flotation beneficiation separations.

The first involves a flotation of phosphate values through the use of an anionic flotation agent such as a fatty acid and caustic in combination with a petroleum fraction, such as kerosene. These reagents are mixed with the aqueous suspension of phosphate rock and the mixture is agitated and aerated or frothed. The phosphate values tend to concentrate in the upper portion of the cell for separation.

The enriched fraction, typically known as the rough concentrate, still contains 8% to 20% siliceous matter which is attempted to be separated from the phosphate rock in a second flotation using a cationic reagent. The cationic reagents used have been long chain fatty acid amines or the salts, thereof.

Various promoters for the anionic flotation of phosphate rock with fatty acids are known in the prior art. (A promoter is a substance which when added to the flotation reagent significantly increases the recovery and/or grade of the phosphate material thereby greatly increasing the efficiency and economics of the flotation process.) Generally speaking, the addition of surfactants to the flotation reagents leads to a trade off between these two parameters. Usually an increase in recovery leads to a corresponding drop in selectivity and vice versa. In today's market, recovery is of utmost importance and consequently promoters which address themselves primarily to increases in recovery are available.

U.S. Pat. No. 3,353,672 discloses as superior reagents for use as collectors for phosphate rock particles chlorinated saturated fatty acids having from 12 to 22 carbon atoms and a melting point between 0° C. and 20° C., preferably chlorinated palmitic acid containing approximately 25% chlorine by weight and chlorinated stearic acid containing approximately 48% chlorine by weight.

U.S. Pat. No. 3,361,257 discloses an improvement in beneficiation of phosphate ores by anionic froth flotation by the addition of from 0.1 to 2.5 pounds sodium fluoride per ton of ore feed, at pH 7.6–9.6, in the conditioning tanks prior to the addition of the anionic reagent.

U.S.S.R. Pat. No. 357,004 teaches the use of the alkali metal soaps of monobasic and dibasic carboxylic acids as the agglomerating agent to improve the flotation of phosphate ores.

In *India, Atomic Energy Commission, Bhabha Atomic Research Center* [*Report*] 1976, B.A.R.C.—857, discloses a phosphate flotation agent comprised of a mixture of linoleic acid, diesel oil and amyl alcohol.

In *Neftepererab. Neftekhim.* (*Moscow*) 1977, a flotation reagent for phosphorite ores is prepared by: oxidation of paraffins at from 165° C. to 170° C. in the presence of 4% boric acid to give a product with an acid number of 40 to 50; washing the product with hot water; saponifying with 40% sodium hydroxide solution at 170° C. for 30 minutes; separating the soap; and diluting with water.

U.S. Pat. No. 4,138,350 describes a combination of a fatty acid and a monoester of sulfosuccinic acid or salt thereof for the improved recovery of non-sulfide ores by froth flotation.

U.S. Pat. No. 4,139,481 describes a combination of a fatty acid and an alkylamidoalkyl monoester of a sulfosuccinic acid or salt thereof as a non-sulfide ore recovery agent in the froth flotation process.

Finally, U.S. Pat. No. 4,139,482 discloses the combination of a fatty acid and an N-sulfodicarboxylic acid aspartate for boostering the recovery of non-sulfide minerals.

As earlier stated, the prior art addresses improving recovery which is only one of the two factors affecting the economics of phosphate flotation.

SUMMARY OF THE INVENTION

It has now been found that certain ether sulfate salts will combine with fatty acids to promote increases in both recovery and selectivity, resulting not only in more phosphate recovered but a higher grade of phosphate as well.

Therefore, the present invention provides an anionic flotation agent for the beneficiation of phosphate ore comprising from about 50% to about 99% by weight of a fatty acid derived from vegetable oil or animal oil and from about 50% to about 1% by weight of an ether sulfate salt of the general formula $$R(OCH_2CH_2)_nOSO_3^-M^+$$

wherein $M^+$ is $Na^+$, $K^+$ or $NH_4^+$, n is from 1 to 6 and R is an alkylaryl group or $CH_3(CH_2)_x$—wherein X is from 6 to 20.

The present invention further provides a process for the beneficiation of phosphate ore which comprises classifying the ore to provide particles of flotation size, slurrying the sized ore in an aqueous medium, conditioning the slurry with an effective amount of a combination of from about 50% to about 99% by weight of a fatty acid derived from vegetable oil or animal oil and from about 50% to about 1% by weight of an ether sulfate salt, and floating the desired ore values by froth flotation, the ether sulfate salt having the structure $$R(OCH_2CH_2)_nOSO_3^-M^+$$

wherein $M^+$ is $Na^+$, $K^+$ or $NH_4^+$, n is from 1 to 6 and R is an alkylaryl group or $CH_3(CH_2)_x$—wherein x is from 6 to 20.

DESCRIPTION OF THE PREFERRED EMBODIMENTS

In the preferred embodiment of the invention, the novel anionic flotation agent combination is employed in the typical phosphate flotation process generally described earlier.

In carrying out froth flotation using the agent of the present invention, phosphate ore containing about 15%–35% BPL (bone phosphate of lime, $Ca_3(PO_4)_2$) is slurried in an aqueous emulsion. The ore slurry is sized at about one millimeter, and the greater than one millimeter fraction is essentially a finished product. The less than one millimeter fraction is further sized at 35 to 200 mesh. The less than 200 mesh slime is discarded. The 35–200 mesh material in thick slurry is conditioned with an effective amount of a combination of from about 50% to about 99% by weight of a fatty acid derived from vegetable oil or animal oil and from about 50% to about 1% by weight of an ether sulfate salt of the general formula $$R(OCH_2CH_2)_nOSO_3^-M^+$$

wherein $M^+$ is $Na^+$, $K^+$ or $NH_4^+$, n is from 1 to 6 and R is an alkylaryl group or $CH_3(CH_2)_x$—wherein x is from 6 to 20.

In addition to the anionic agent combination, conditioning may also include such other reagents as are conventionally employed. The phosphate ores are generally processed at a pH value in the range of about 6.0 to 12.0, preferably 8.0 to 10.0. Accordingly, suitable pH regulators may be used as well as frothers, fuel oil and the like.

After the slurry is conditioned, it is subjected to froth flotation following conventional procedures. The desired mineral values are recovered with the froth and the gangue remains behind.

The combination of a vegetable or animal oil derived fatty acid and the ether sulfate salt provided by the present invention provides superior performance in the froth flotation of phosphate ores over either component alone and gives higher recovery and grade than conventionally employed flotation agents.

Illustrative of the vegetable or animal oils from which the fatty acid of the present invention is derived are: babassu, butterfat, castor, cocoa butter, coconut, corn, cottonseed, herring, lard, linseed, menhaden, mustard seed, neatsfoot, oiticica, olive, palm, palm kernel, peanut, perilla, rapeseed, rice bran, safflower, sardine, sesame, soybean, sperm, sunflower, tall, tallow, tung and whale. These oils contain acids ranging from four to twenty-four carbon atoms or more which may be saturated or unsaturated, hydroxylated or not, linear or cyclic and the like. Of course, a mixture of two or more such acids could be employed. The second essential ingredient comprising the invention flotation agent, the promoter, is an ether sulfate salt of the general formula $$R(OCH_2CH_2)_nOSO_3^-M^+$$

wherein $M^+$ is $Na^+$, $K^+$ or $NH_4^+$, n is from 1 to 6 and R is an alkylaryl group or $CH_3(CH_2)_x$—wherein x is from 6 to 20. The sodium ether sulfate salt, wherein n is 3 and R is $CH_3(CH_2)_x$—wherein x is from 10 to 15 is preferred. Also, when R is an alkylaryl group, nonyl phenol or octyl phenol is the preferred alkylaryl group.

As indicated, the fatty acid (or fatty acid mixture) comprises from about 50% to about 99% by weight and, correspondingly, from about 50% to about 1% by weight the ether sulfate salt. A preferred anionic flotation agent is one containing from about 65% to about 95% by weight of fatty acid and, correspondingly, from about 35% to about 5% by weight of the ether sulfate salt. The most preferred agent contains 85% by weight of fatty acid and 15% by weight of ether sulfate salt.

The invention is more fully illustrated in the examples which follow wherein all parts and percentages are by weight unless otherwise specified. The following general procedure was employed in the froth flotation examples given:

1. Wet sized rock feed, e.g., the 35×200 mesh fraction as described above, was analyzed for moisture to determine the amount of wet sample required to yield 1,000 grams of dry rock. (For example, at 85% solids, 1,176 grams of wet rock would be equivalent to 1,000 grams of dry rock.)

2. Water-soluble reagents were diluted to 10% solids and added to the feed sample at the desired concentrations. Generally, 1.5, 3.0, 4.5 and 6.0 milliliters of the 10% solution were added to give a representative indication of the reagent performance at various concentrations. These amounts converted respectively to 0.3, 0.6, 0.9 and 1.2 pounds of reagent per ton of feed for each 1,000 gram charge. A mixture of #5 fuel oil (90%) and kerosene (10%) was added, for the above reagent concentrations, 0.15, 0.33, 0.484 and 0.659 milliliters of the fuel oil should be added. (Note: Any insolubles were mixed 1:1 with the fuel oil and added directly to the feed.) The pH of the rock-reagent-fuel oil mixture was adjusted to ~9.2 with 20% NaOH. Then the charge was diluted to 72% solids and conditioned for 1.5 minutes.

3. The conditioned charge was transferred to the 2,000-gram cell of the flotation machine, which was positioned beneath an impeller shaft on the unit platform. The water level in the cell was raised to within ½ inch of the cell lip.

4. The charge was floated for one minute with air introduced after 10 seconds of mixing (conditioning). The float fraction, called the concentrate, was collected during the one minute flotation using a level paddle to rake across the froth at the top of the cell, forcing the floating material over the lip and into a collection pan. The water level in the cell must be adjusted periodically as water is forced out, and care must be taken to use smooth, even strokes across the froth so that none of the non-floating material is collected. The excess water was decanted from the pan, being careful not to lose any concentrate.

5. The water in the cell should be likewise poured out, leaving the non-floating fraction in the bottom. This is called the tailings. The tailings were transferred to another collection pan by inverting the cell above the pan and rinsing the material down one side only into the pan. The water in this pan should also be carefully poured off.

6. The float fractions were oven-dried (105° C.), and the dry weight was recorded and the weight fractions calculated. The dried samples were reduced by splitting them to obtain representative 20–80 gram samples for bone phosphate of lime (BPL) and acid insolubles (AI) analyses.

Recovery of the mineral values is the most important measure for float effectiveness and was calculated thus: % Recovery = Wt. % Concentrate x % BPL-Concentrate/% BPL-Feed. The concentrate grade, is a reflection of the % BPL in the float concentrate. Therefore, % BPL-Concentrate = Concentrate Grade.

EXAMPLE 1

Following the above-outlined general procedure using Florida phosphate ore, froth flotations were run using the same fatty acid mixture both with and without the ether sulfate promoter. The promoter-containing reagent was added to the wet feed prior to conditioning at a fatty acid mixture:promoter ratio of 2:1. The fatty acid mixture was tall oil derived and included minor amounts of resin acids and pitch. All reagents were added with a 10 cc. syringe. The rock pH was adjusted to 9.1–9.2 with a 20% solution of sodium hydroxide. Results and evaluation of the tests are given in Table I below:

TABLE I

| Reagent | Consumption (Lbs./Ton Total) | Conc. BPL % | Conc. Insols. % | Tails BPL % | Tails Insols. % | Recovery % |
|---|---|---|---|---|---|---|
| Fatty Acids | .3 | 35.40 | 49.56 | 13.93 | 79.50 | 10.56 |
| | .6 | 41.52 | 42.99 | 6.56 | 90.15 | 64.84 |
| | .9 | 40.86 | 43.71 | 3.28 | 94.55 | 84.36 |
| | 1.2 | 36.27 | 49.66 | 1.97 | 94.60 | 90.28 |
| Fatty Acids Plus Sodium Salt of Sulfonated 3-Mole Ethoxylate of C-12 to C-15 Alcohol | .3 | 55.06 | 23.65 | 7.65 | 86.54 | 57.34 |
| | .6 | 53.97 | 25.09 | 3.06 | 94.55 | 83.00 |
| | .9 | 52.88 | 26.99 | 2.40 | 95.86 | 89.02 |
| | 1.2 | 53.53 | 25.20 | 1.75 | 96.39 | 92.29 |

The results indicate an 18% increase in recovery, coupled with a 15% average increase in BPL, or grade compared to fatty acids alone. The superiority of this combination is readily obvious upon examination of the data; the sulfonated alcohol ethoxylate additive is decidedly higher in all parameters.

EXAMPLE 2

Again following the general procedure above, froth flotations were run on phosphate ore using the tail oil derived fatty acid mixture of Example 1 both with and without promoter. In this example the promoter is the sodium salt of sulfate ester of an alkyl-phenoxy-poly(ethyleneoxy)ethanol. The promoter is employed in the ratio of 4:1, fatty acid to promoter. The results are reported in Table II.

TABLE II

| Reagent | Consumption (Lbs./Ton Total) | Conc. BPL % | Conc. Insols. % | Tails BPL % | Tails Insols. % | Recovery % |
|---|---|---|---|---|---|---|
| Fatty Acids | .3 | 54.41 | 25.82 | 16.17 | 77.90 | 15.98 |
| | .6 | 44.14 | 38.81 | 6.99 | 90.30 | 73.70 |
| | .9 | 41.95 | 41.93 | 4.37 | 92.96 | 86.88 |
| | 1.2 | 35.62 | 50.63 | 4.37 | 93.12 | 85.96 |
| Fatty Acids Plus Promoter | .3 | 62.05 | 15.36 | 14.64 | 79.41 | 20.49 |
| | .6 | 60.96 | 17.02 | 6.99 | 90.36 | 64.54 |
| | .9 | 57.68 | 22.41 | 5.90 | 91.75 | 80.79 |
| | 1.2 | 55.50 | 22.94 | 4.57 | 93.22 | 99.00 |

While the results indicate only a slight overall increase in recovery (0.6% average increase) when the promoter is added, the increase in grade was a significant 15%.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

I claim:

1. A process for the beneficiation of phosphate ore which comprises slurrying the ore in an aqueous medium, classifying the slurried ore to provide particles of flotation size, conditioning the slurry with an effective amount of a combination of from about 50% to about 99% by weight of a fatty acid derived from an oil selected from the group consisting of vegetable oil and animal oil and from about 50% to about 1% by weight of an ether sulfate salt, and floating the desired ore values by froth flotation, the ether sulfate salt having the structure $$R(OCH_2CH_2)_nOSO_3^-M^+$$

wherein $M^+$ is $Na^+$, $K^+$ or $NH_4^+$, n is from 1 to 6 and R is an alkylaryl group or $CH_3(CH_2)_x$—wherein x is from 6 to 20.

2. The process of claim 1 wherein R is an alkylaryl group selected from the group consisting of nonyl phenol and octyl phenol.

3. The process of claim 2 wherein the fatty acid is present in an amount of 80% by weight and the ether sulfate salt is present in an amount of 20% by weight.

4. The process of claim 1 wherein R is $CH_3(CH_2)_x$— wherein x is from 10 to 15, n is 3 and $M^+$ is $Na^+$.

5. The process of claim 1 wherein the fatty acid is derived from tall oil.

6. The process of claim 1 wherein the amount of slurry conditioning combination is from 0.3 to 1.2 pounds per ton of phosphate ore, based on the dry weight of the ore.

7. The process of claim 1 wherein the conditioning step is conducted in the presence of a quantity of sodium hydroxide sufficient to give a slurry pH in the range of from 6.0 to 12.0.

8. The process of claim 7 wherein the slurry pH is in the range of from 8.0 to 10.0.

* * * * *